US010005613B2

(12) United States Patent
Castellano et al.

(10) Patent No.: US 10,005,613 B2
(45) Date of Patent: Jun. 26, 2018

(54) NON-ENTRY TANK CLEANING

(71) Applicants: Nicholas Castellano, Mesa, AZ (US); Matthew S. Wyatt, Beach Centre (SG)

(72) Inventors: Nicholas Castellano, Mesa, AZ (US); Matthew S. Wyatt, Beach Centre (SG)

(73) Assignee: HCDI HOLDINGS LIMITED, Wanchai (HK)

( * ) Notice: Subject to any disclaimer, the term of this patent is extended or adjusted under 35 U.S.C. 154(b) by 846 days.

(21) Appl. No.: 13/950,163

(22) Filed: Jul. 24, 2013

(65) Prior Publication Data

US 2014/0027455 A1 Jan. 30, 2014

Related U.S. Application Data

(60) Provisional application No. 61/675,287, filed on Jul. 24, 2012.

(51) Int. Cl.

| | |
|---|---|
| ***B65D 88/34*** | (2006.01) |
| ***B65D 90/00*** | (2006.01) |
| ***B08B 9/08*** | (2006.01) |
| ***B08B 9/093*** | (2006.01) |

(52) U.S. Cl.

CPC ..... *B65D 88/34* (2013.01); *B08B 9/08* (2013.01); *B08B 9/0933* (2013.01); *B65D 90/0093* (2013.01)

(58) Field of Classification Search

None

See application file for complete search history.

(56) References Cited

U.S. PATENT DOCUMENTS

| | | | | |
|---|---|---|---|---|
| 4,069,147 | A * | 1/1978 | Abrams | C02F 3/12 210/604 |
| 4,828,625 | A * | 5/1989 | Moran | B08B 9/0933 134/168 R |
| 4,944,845 | A * | 7/1990 | Bartholic | B01J 8/085 196/120 |
| 5,085,710 | A * | 2/1992 | Goss | B08B 9/0933 134/22.14 |
| 5,580,391 | A * | 12/1996 | Franco | B08B 9/08 134/19 |
| 5,591,272 | A * | 1/1997 | Hummer | B08B 9/0933 134/10 |
| 2008/0023050 | A1* | 1/2008 | Hancock | B08B 9/0933 134/99.2 |
| 2008/0037371 | A1* | 2/2008 | Chang | G01S 7/52004 367/137 |

* cited by examiner

*Primary Examiner* — Nicole Blan

(74) *Attorney, Agent, or Firm* — Jiarong L. Lamiquiz; Quarles & Brady LLP

(57) ABSTRACT

A method for removing sludge from a crude oil storage tank comprising a bottom and a moveable roof configured to float on the top of a quantity of crude oil disposed in said storage tank, where the method includes reducing a volume of crude oil in the storage tank to about a level of a sludge sediment in the storage tank, measuring a topology of the sludge disposed on said bottom, reliquefying asphaltene deposits, pumping the reliquefying asphaltene deposits out of the storage tank, wherein the method is performed without the entry of one or more persons into said storage tank.

15 Claims, 5 Drawing Sheets

NON-ENTRY TANK CLEANING

CROSS-REFERENCE TO RELATED APPLICATIONS

This Application claims priority to a U.S. Provisional Application filed Jul. 24, 2012, and having Ser. No. 61/675,287, which is hereby incorporated by reference.

FIELD

Embodiments generally relate to tank cleaning and more particularly to compositions of matter, articles of manufacture, methods, devices, and systems for non-entry hydrocarbon tank cleaning.

BACKGROUND

High molecular weight organic sediments deposit in tanks that store crude oil. These deposits form sludge, which reduces the storage capacity of the tank. Industry maintenance of such tanks requires their frequent cleaning, which imposes risks to the cleaning crew and the environment, and renders the tank inoperable for a period of time. The potential hazards for man entry systems include mortal harm to the cleaning crew due to chemical exposure, asphyxia, and risk of combustion of the tank content. For example, electrostatic charges originating from spray mists or body movements (electrostatic charges from rubbing of clothing) has the potential to ignite the content of the tank leading to a dangerous explosion. Moreover, the disposed sludge often includes oil, which results in cargo loss, amounting to a shortfall in usable oil and revenue.

Accordingly, it would be an advance in the art to provide solutions that can address the above challenges.

SUMMARY

In certain embodiments, a desludging storage tank includes a tank body and a fluid injection device. The fluid injection device includes an outlet end directed into the tank body and an opposite, inlet end coupled to a source of fluid that includes diesel.

In certain embodiments, a method for desludging a storage tank includes reducing a volume of crude oil in the storage tank to about a level of a sludge sediment in the storage tank. A topology of the sludge sediments on a first inner surface of the storage tank is measured. An additive and diesel are injected into the storage tank. A heating coil heats the sludge sediment. Nitrogen is injected into the storage tank. The liquefied sludge sediments are pumped out of the storage tank.

BRIEF DESCRIPTION OF THE DRAWINGS

The invention will be better understood from a reading of the following detailed description taken in conjunction with the drawings in which like reference designators are used to designate like elements, and in which.

DETAILED DESCRIPTION

The invention is described in preferred embodiments in the following description with reference to the FIGS., in which like numbers represent the same or similar elements. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," "in certain embodiments," and similar language throughout this specification may, but do not necessarily, all refer to the same embodiment. It is noted that, as used in this description, the singular forms "a," "an" and "the" include plural referents unless the context clearly dictates otherwise.

The described features, structures, or characteristics of the invention may be combined in any suitable manner in one or more embodiments. In the following description, numerous specific details are recited to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Sludge and gels are produced by the gradual sedimentation of heavy oil fractions in a storage tank. Sludge is an emulsion, varying in thickness, consistency, density, and composition across the storage tank bottom. These sediments are typically a stable, multiphase solid/oil/water product, that is in a semisolid physical state. Inorganic solids in the crude oil, (e.g., clay, calcite, silica, and corrosion-produced residues) bring more hardness and increase density to the sludge. During storage, accumulating sediment compacts with organic compound degradation that produces a thick layer of sludge deposits at the bottom of the tank, which is difficult to remove.

Figure 1:
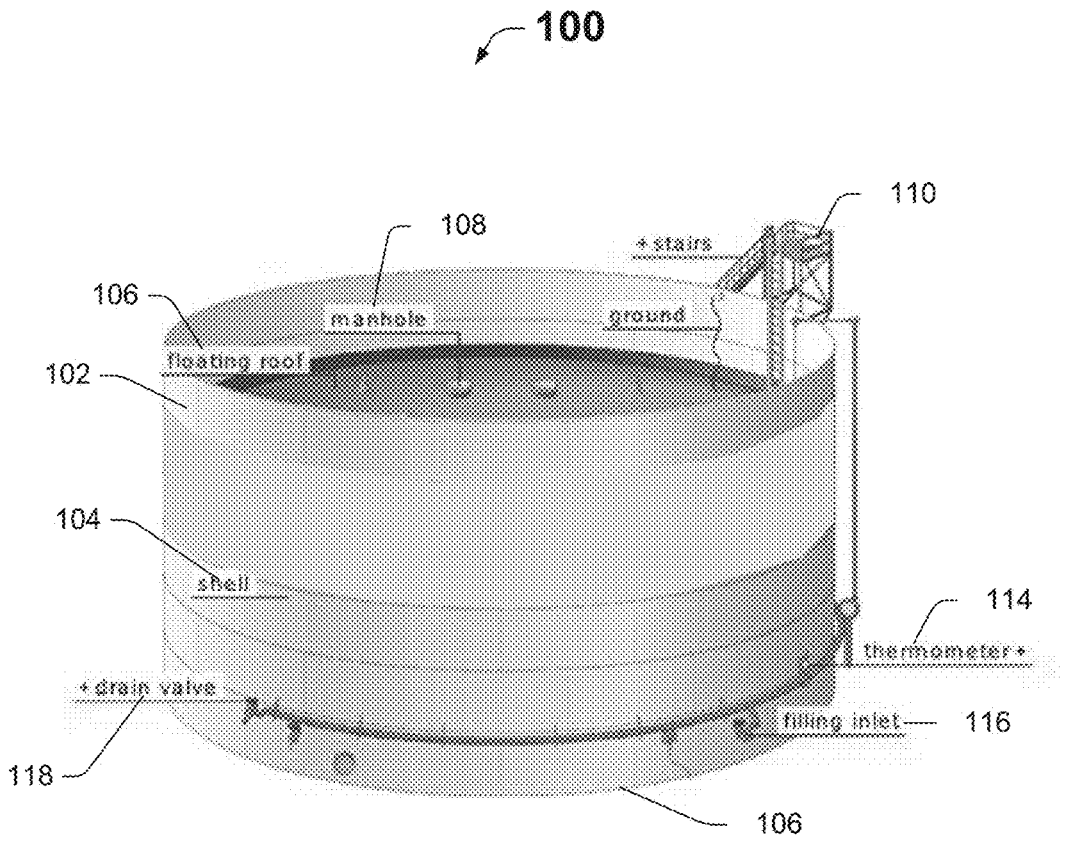
FIG. 1 is a schematic of an exemplary storage tank.

Referring to FIG. 1, a crude oil storage tank 100 is illustrated. The storage tank 100 body stores crude oil, for example, and includes at least one side 102 coupled to a bottom 106. Here, the side of the storage tank 100 body is shown as a cylindrical shell 104 that is coupled to a circular bottom. Other configurations are also contemplated, such as a polygon configuration, spherical configuration, and the like. Storage tank 100 has a large volume capacity. In certain embodiments, the volume capacity of the storage tank 100 is within a range of 5,000-10,000 Metric Tons of crude oil, with a cross-sectional diameter of about 75 meters or more. In certain embodiments, the storage tank 100 body, and other tank bodies disclosed herein, are made of metal, such as steel, that has a corrosion resistive coating with a cathodic protection system.

Storage tanks that hold fluid have fixed or floating roofs based on the intended functionality and/or the flash-point of the substance contained in the storage tank. In FIG. 1, the storage tank 100 is illustrated as having a floating roof 106 that is configured to rise or fall with the level of the content inside the storage tank 100, which decreases the vapor space above the liquid level. The storage tank 100 of FIG. 1 includes means for personnel access. Stairs 110 lead up to the floating roof 106 and a manhole 108 is disposed on the floating roof 106. The tank 100 further includes an outlet shown as a drain valve 118 for draining the content of the storage tank 100 and a filling inlet 116 for filling the storage tank 100. In certain embodiments, an externally accessible thermometer 114 allows for detection of the temperature of the content in the storage tank 100.

Use of a desludging storage tank allows for about 80-100% full crude value recovery. A desludging storage tank includes an additive for a thremochemical treatment of oil sludge. The additive reliquefies sludge or residual oil, such as waxy (paraffinic) or asphaltene deposits. The additive is a powerful emulsion breaker that de-stabilizes emulsions. In certain embodiments, the additive works in lieu of expensive surfactant as it treats the crude directly and does not dilute in the water phase as the product is hydrophobic in nature and repels aqueous solutions.

In certain embodiments, the additive re-mediates petroleum based compounds such as heavy oils by replacing the lost volatile fractions with temperature resistant molecules which do not vent easily. The additive is organic in nature with no catalyst poisoning and produces a long lasting effect of creating flowable crudes without wax reformation. In certain embodiments, the additive is devoid of contaminating agents that provoke the alkalinization of the solution.

In certain embodiments, Applicants' additive comprises a combination of hydrocarbons obtained by treating a petroleum fraction with hydrogen in the presence of a catalyst. It consists of hydrocarbons having carbon numbers predominantly in the range of $C_9$ through $C_{16}$ and boiling in the range of approximately 150° C. to 290° C. (302° F. to 554° F.).

In certain embodiments, Applicants' additive is formed by a fractional distillation of crude oil between 200° C. (392° F.) and 350° C. (662° F.) at atmospheric pressure, resulting in a mixture of carbon chains that typically contain between 8 and 21 carbon atoms per molecule.

In certain embodiments, Applicants' additive comprises a hydrogenated, light petroleum distillate. In certain embodiments, Applicants' additive comprises a mixture of hydrocarbon compounds, wherein that mixture is assigned Chemical Abstracts System ("CAS") Number 64742-47-8. In certain embodiments, Applicants' additive comprises a product sold in commerce under the tradename Drakesol 165. In certain embodiments, Applicants' additive comprises a product sold in commerce under the tradename Drakesol 2251. In certain embodiments, Applicants' additive deodorized kerosene.

In certain embodiments, Applicants' additive comprises a hydrogenated, medium petroleum distillate. In certain embodiments, Applicants' additive comprises a mixture of hydrocarbon compounds, where that mixture is assigned CAS No. 64742-46-7. In certain embodiments, Applicants' additive comprises a product sold in commerce under the tradename Drakesol 205. In certain embodiments, Applicants' additive comprises a product sold in commerce under the tradename Drakesol 2257.

Figure 2:
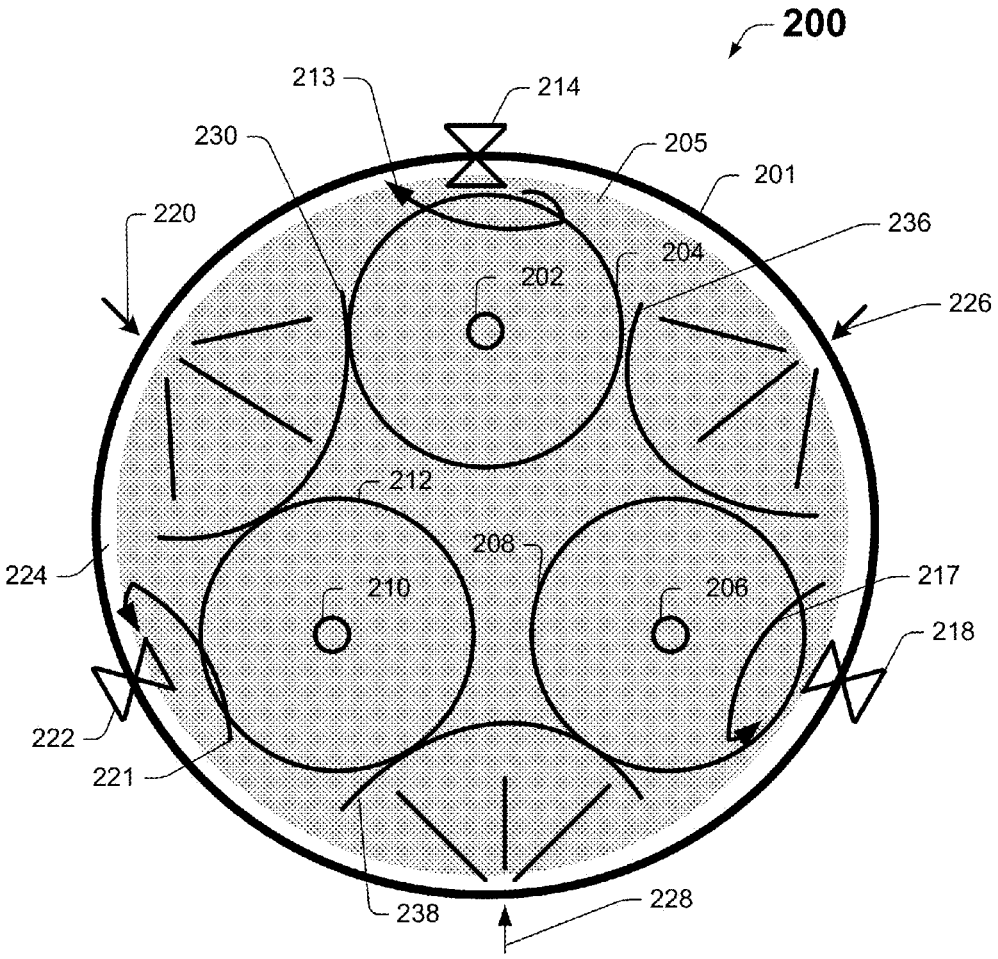
FIG. 2 is a schematic showing a top, cross-sectional view of a desludging storage tank.
Figure 3:
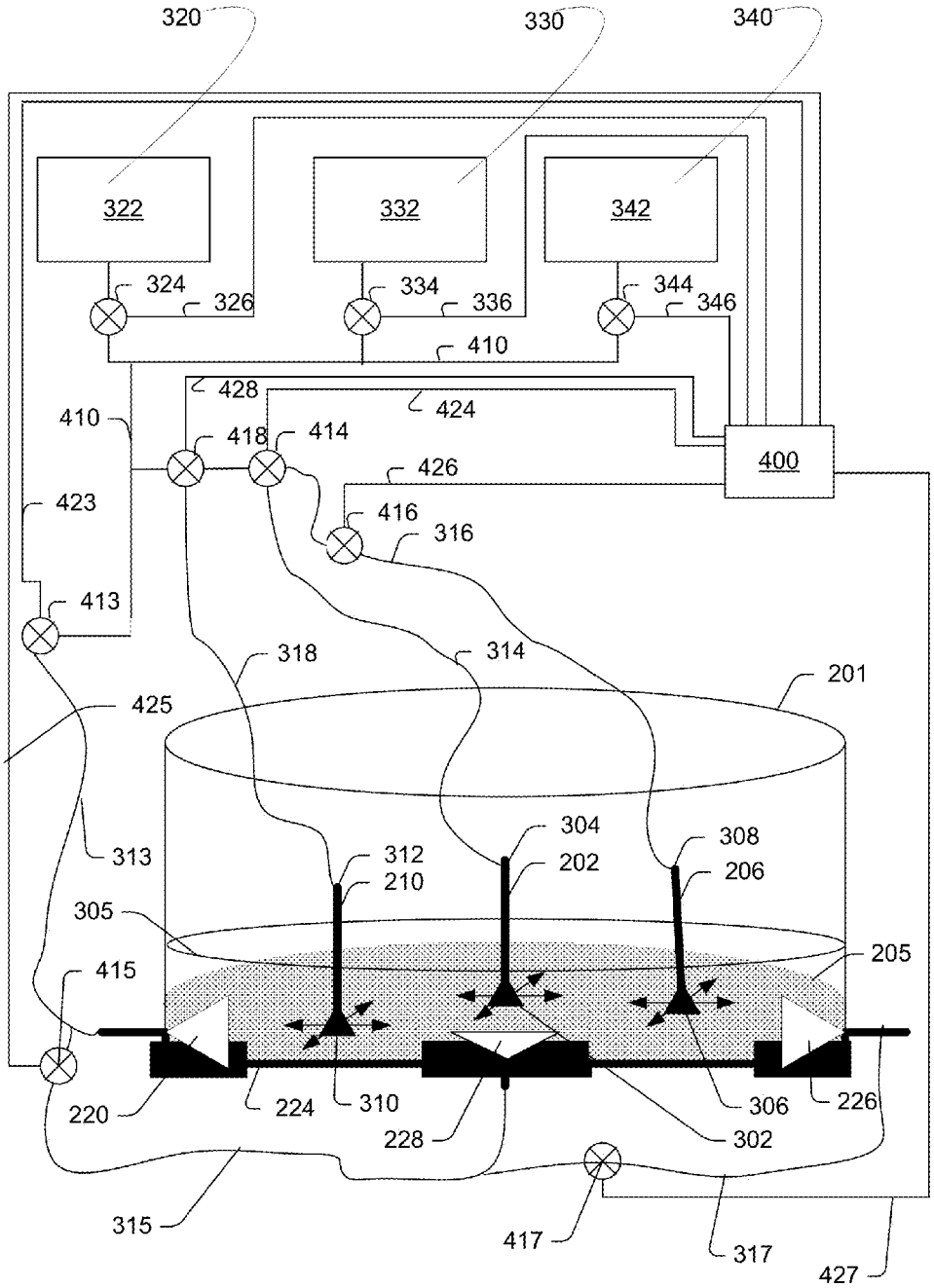
FIG. 3 is a schematic showing a side view of the desludging storage tank of FIG. 2, wherein the shell and the roof of the desludging storage tank is transparent to illustrate the internal components of the desludging storage tank.

Referring to FIGS. 2 and 3, a desludging storage tank 200 is depicted in a top, cross-sectional view and a side view, respectively. For illustrative purposes, FIG. 3 shows the wall or side 201 of the desludging storage tank 200 body and roof as transparent in order to illustrate the desludging storage tank's 200 inner workings. The desludging storage tank 200 body includes a wall or side 201 coupled to a bottom 224. As stated previously, other configurations for the body of the desludging storage tank 200 are also contemplated. A floating roof 305 is configured above the bottom 224 of the desludging storage tank 200. Here, the crude oil has been removed from the desludging storage tank 200 exposing the sludge 205 deposited at the bottom 224 of the desludging storage tank 200.

The desludging storage tank 200 includes a fluid injection device configured to inject one or more fluids, such as a first fluid from fluid reservoir 320 (e.g., a liquid reservoir) and/or a second fluid from fluid reservoir 330 and/or a third fluid from fluid reservoir 340, into the storage tank 200. In certain embodiments, the first fluid is the additive, the second fluid is diesel, and the third fluid is nitrogen (e.g., 62,500 m3 nitrogen from nitrogen pallets).

In certain embodiments, the fluid injection device includes one or more movable, vertical lances 202, 206, and 210, each having an outlet end (302, 306, and 310, respectively) and an opposite, inlet end (304, 308, and 312, respectively). Here, the outlet end of the lances 202, 206, and 210 are each coupled to a corresponding tripod to stabilize the lance. Although three lances 202, 206, and 210 are shown in FIGS. 2 and 3, any number of lances are applicable, such as between zero and 500 lances. In certain embodiments, the lances 202, 206, and 210 are mobile such that they can be configured anywhere within the tank. In FIGS. 2 and 3, the lances 202, 206, and 210 are shown to be configured to be somewhat equal distance from one another within the tank. The lances 202, 206, and 210 are coupled to the floating roof 305.

The respective inlet ends 302, 306, and 310 of the lances 202, 206, and 210 are each coupled to a liquid delivery system that delivers a fluid from one or more fluid reservoir 320 and/or fluid reservoir 33 and/or fluid reservoir 340, into the desludging storage tank 200. In FIG. 3, the fluid delivery system includes fluid reservoirs 320, 330, and 340, that are each coupled to one or more of the lances 202, 206, and 210 via fluid manifold 410 and hosing or pipes 314, 316, and 318, respectively. Other configurations are also contemplated. In certain embodiments, the fluid reservoir 320 is coupled to a first set of lances while fluid reservoir 330 is coupled to a different, second set of lances, and the like. In certain embodiments, pumps and valves push fluid through the fluid delivery system for injection into the storage tank 200.

The respective outlet ends 304, 308, and 312 of the lances 202, 206, and 210 are each configured to inject the fluid(s) from the fluid delivery system into the desludging storage tank 200. Each lance 202, 206, and 210 has a respective fluid propelling capacity. The fluid propelling capacity of each lance 202, 206, and 210 is a volume or spatial distance around the outlet end of the respective lance within which the fluid will be injected from the respective lance into the desludging storage tank 200. In FIG. 3, the spatial distance for the lances 202, 206, and 210 is illustrated as the fluid propelling capacities 204, 208, and 212, respectively.

Alternatively, or in combination to having one or more lances 202, 206, and 210, in certain embodiments the fluid injection device includes injection points disposed on one or more walls 201 of the desludging storage tank 200. In FIGS. 2 and 3, injection points 220, 226, and 228 are depicted. Although three injection points 220, 226, and 228 are depicted in FIGS. 2 and 3, any number of injection points are applicable, such as between zero to 500 injection points. Each injection point 220, 226, and 228 has its own respective fluid propelling capacity, depicted as 230, 236, and 238, respectively, in FIG. 2.

In certain embodiments the desludging storage tank 200 includes an agitation system which increases the pressure and flow of fluid within the desludging storage tank 200. For example, in certain embodiments, the agitation system includes one or more impellers, agitators and/or recirculation pumps that are deposed on or within the desludging storage tank 200. Referring to FIG. 2, three impellers 222, 214, and 218 are disposed on the wall 201 of the desludging storage tank 200. The impellers are made of materials such as of iron, steel, bronze, brass, aluminum or plastic, for example. Although three impellers 222, 214, and 218 are illustrated in FIG. 2, any number of impellers are applicable, such as between zero and 500 impellers. The impellers 222, 214, and 218 of FIG. 2, rotate accelerating the fluid within the desludging storage tank outwards from the center of rotation of the respective impeller (shown as motions 221, 213, and 217, respectively).

Referring to FIG. 3, external fluid reservoir 320 is partially or completely filled with a first fluid 322. In certain embodiments, first fluid 322 comprises Applicants' additive. Valve 324 controls release of fluid 322 into manifold 410. Valve 324 is interconnected with controller 400 via communication link 326.

External fluid reservoir 330 is partially or completely filled with a second fluid 332. In certain embodiments, second fluid 332 comprises diesel fuel. Valve 334 controls release of fluid 332 into manifold 410. Valve 334 is interconnected with controller 400 via communication link 336.

External fluid reservoir 340 is partially or completely filled with a third fluid 342. In certain embodiments, third fluid 342 comprises nitrogen. Valve 344 controls release of fluid 342 into manifold 410. Valve 344 is interconnected with controller 400 via communication link 346.

Valve 418 controls release of one or more fluids from manifold 410 into piping 318. Valve 418 is interconnected with controller 400 via communication link 428.

Valve 414 controls release of one or more fluids from manifold 410 into piping 314. Valve 414 is interconnected with controller 400 via communication link 424.

Valve 416 controls release of one or more fluids from manifold 410 into piping 316. Valve 416 is interconnected with controller 400 via communication link 426.

Valve 413 controls release of one or more fluids from manifold 410 into fluid injection device 220 via piping 313. Valve 413 is interconnected with controller 400 via communication link 423. Valve 415 controls release of one or more fluids from piping 313 into fluid injection device 228 via piping 315. Valve 415 is interconnected with controller 400 via communication link 425. Valve 417 controls release of one or more fluids from piping 315 into fluid injection device 226 via piping 317. Valve 417 is interconnected with controller 400 via communication link 427.

Figure 4:
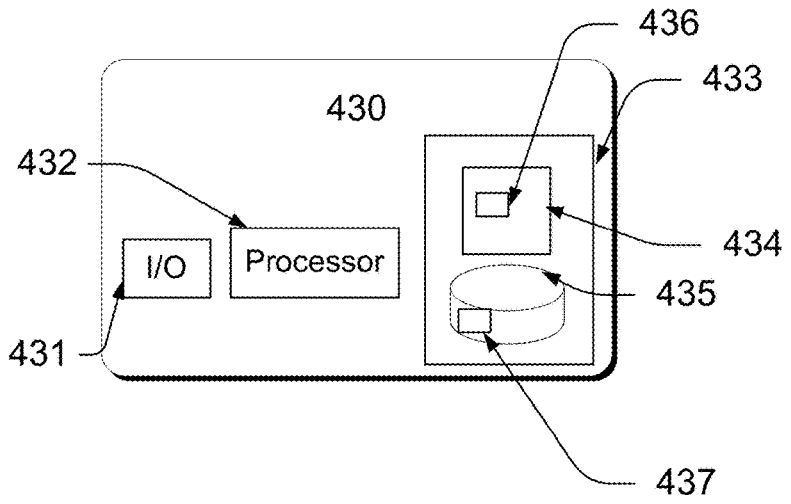
FIG. 4 illustrates Applicants' crude oil storage tank in combination with a plurality of computer-operated valves.

In certain embodiments, the fluid delivery system and/or the fluid injection device and/or the agitation system are controlled by a controller 400. Referring to FIG. 4, a controller is illustrated as a computing device 430. Although a single computing device 430 is depicted in FIG. 4, any number of computing devices is applicable to control the fluid delivery system, and/or the fluid injection device, and/or the agitation system. In certain embodiments, the computing device 430 is an article of manufacture. Examples of an article of manufacture include: a server, a mainframe computer, a laptop, or other special purpose computer having one or more processors (e.g., a Central Processing Unit, a Graphical Processing Unit, programmable processor, and/or a microprocessor) that is configured to execute an algorithm (e.g., a computer readable program or software) to receive data, transmit data, store data, or performing methods, for example.

By way of illustration and not limitation, FIG. 4 illustrates the computing device 430 as including: a processor 432; a non-transitory computer readable medium 433 having a series of instructions, such as computer readable program steps encoded therein; an input/output means 431 such as a keyboard, a mouse, a stylus, touch screen, a camera, a scanner, or a printer. Computer readable program code 434 is encoded in non-transitory computer readable medium 433. In certain embodiments, the non-transitory computer readable medium 433 includes data repository 435. The processor 432 accesses computer readable program code 434, encoded in non-transitory computer readable medium 433 and executes one or more corresponding instructions 436. In certain embodiments, the non-transitory computer readable medium 433 comprises one or more hard disk drives, tape cartridge libraries, optical disks, and combinations thereof.

In certain embodiments the data stored in the data repository 435 of the computing device 430 includes information received from the fluid injection device or agitation system. A log 437 is maintained of the information or data about the communicated information (e.g., date and time of transmission, frequency of transmission . . . etc.) with the computing device 430. In certain embodiments, Applicants' method reviews, analyzes, or mines log 437 and generates reports.

In certain embodiments, the data repository 435 comprises any suitable data storage medium, storing one or more databases, or the components thereof, in a single location or in multiple locations, or as an array such as a Direct Access Storage Device (DASD), redundant array of independent disks (RAID), virtualization device, and the like. In certain embodiments, the data repository 435 is structured by a database model, such as a relational model, a hierarchical model, a network model, an entity-relationship model, an object-oriented model, or a combination thereof. For example, in certain embodiments, the data repository 435 is structured in a relational model and stores data as attributes in a matrix.

In certain embodiments, the desludging storage tank 200 includes (not shown) one or more pumps (e.g., Wilden Pumps PX-15 for chemical & diesel transfer); hosing and/or plumbing (e.g., 120 m per roof injection point); air compressors; cranes (e.g., mob and demob); cabin—lab; laboratory equipment (e.g., for monitoring samples); sludge canons configured to create a vortex, in certain embodiments the cannons are configured to move 660 Metric Tons per hour at 10 bar; power packs (e.g., generators and/or pumps); nozzles for injection points; or a combination thereof.

In certain embodiments the desludging storage tank 200 is prefabricated, in which the body of the desludging storage tank 200, and/or the fluid injection device, the fluid delivery system, and/or the controller, and/or the agitation system, and the like are prefabricated as one unit. In other embodiments, the desludging storage tank includes an existing tank body that is retrofitted to include at least one of the fluid injection device, the fluid delivery system, the controller, the agitation system, and the like.

Figure 5:
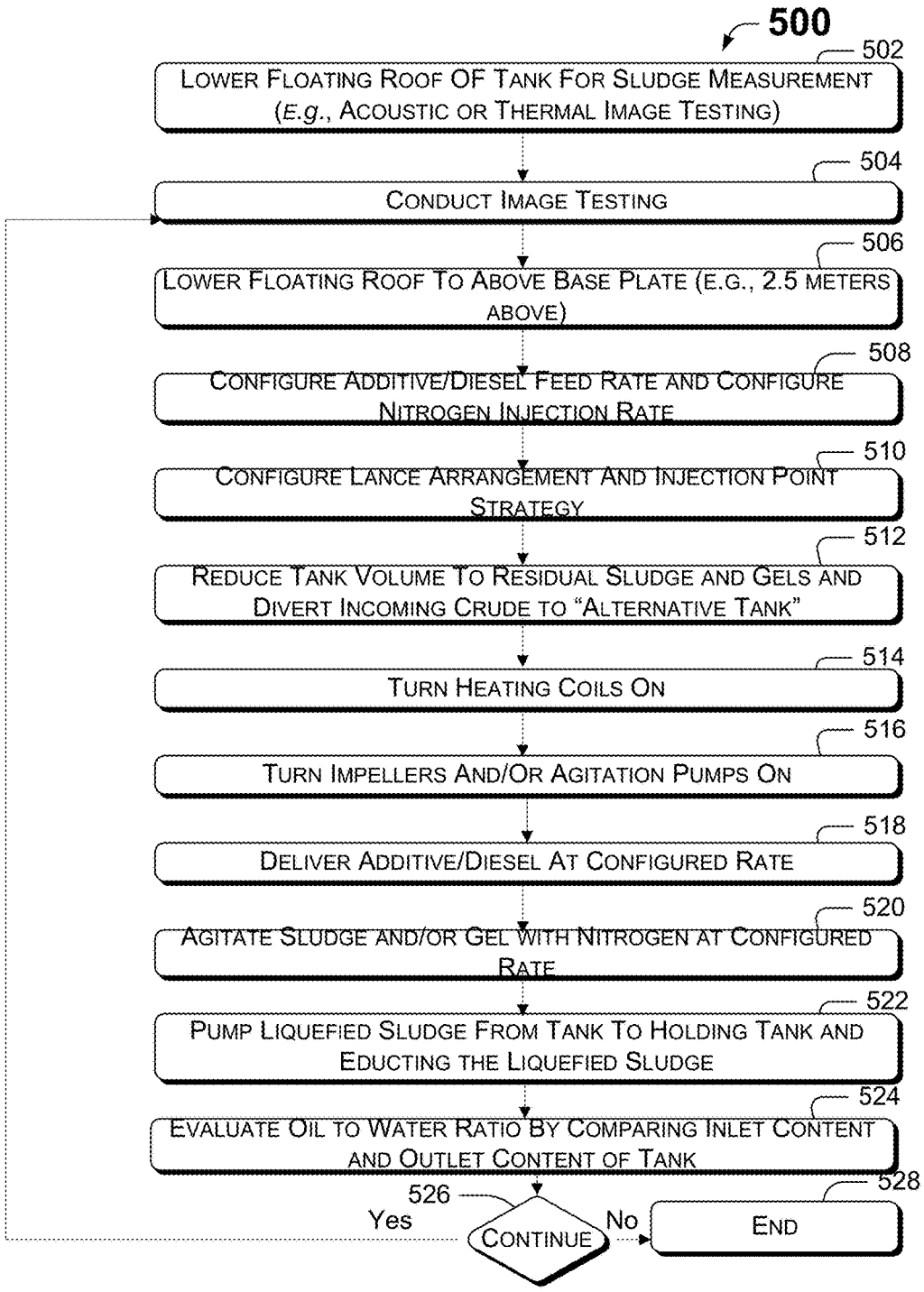
FIG. 5 is a flow chart of an exemplary method for non-entry tank cleaning.

Referring to FIG. 5, a flow chart summarizes Applicants' method for removing sludge deposits from a crude oil storage tank without the entry of one or more persons into that storage tank. Initially the crude oil stored in the desludging storage tank 200 is transferred to a holding tank. At step 502, the floating roof 305 of the desludging storage tank 200 is lowered for image testing of an inner surface of a storage tank (e.g., the bottom 224 of the desludging storage tank 200). To illustrate, the floating roof 305 is lowered, such as to about 0.005-5 meters above the highest peak of the sludge deposited at the bottom 224 of the desludging storage tank 200.

At step 504, the image testing is conducted. In certain embodiments, an acoustic inspection system and/or thermal inspection system is used to measure a volume and/or determine a topology of the sludge sediments in the storage tank. For example, an exemplary acoustic inspection system includes an inspection tool that is inserted into the tank through a suitable access hole in the roof until fully submerged in the liquid. The end of the tool has an angled phased array that produces acoustic beams to scan a sector of the desludging storage tank 200 floor (e.g., bottom 224) and wall (e.g., wall 201). The sector is a percentage of the floor such as between zero and 100% of the floor, more specifically between 80-100 percent of the floor, and preferably 100% of the floor. To illustrate, a T-Type Acoustic Inspection System measures the volume and topology of sludge sediments on the bottom 224 of the storage tanks 200. The image is then recorded and the topology evaluated to map lance and/or injection point configuration and strategy.

Alternatively, or in combination, a thermal inspection system is used to measure a volume and determine a topology of the sludge sediments on an inner surface of the desludging storage tank 200. Here, the thermal inspection system has no sound interference risks. When combined with spectroscopy, the thermal inspection system is configured to distinguish Oil Paraffin Water and Solids phases.

In certain embodiments, a computing device, such as computing device 430, is communicatively connected to the acoustic and/or thermal inspection system to control the image testing. The computing device uses the acquired data to produce an image (e.g., 3D display) of the sediment layer and calculates the volume of sediment using a known geometry of the tank. Sector data from multiple entry points is combined to give 100% coverage of the tank floor, for example.

At step 506, the floating roof 305 is lowered above the base place, such as configuring the floating roof 305 to about 2.5 meters above the base plate. At step 508, the additive/diesel feed rate is configured. For example, the feed rate for the additive in liquid source 320 of FIG. 3 is set to about 1:6 ratio to the diesel in the liquid source 330. The volume of feed rate is also configured, for example, to about 2 gallons of additive and 12 gallons of diesel per metric ton of sludge measured, for example, at step 504. At step 508, the nitrogen injection rate is also configured and corresponding heater is setup (e.g., 62,500 m3 nitrogen from nitrogen pallets). At step 510, the lance arrangement is configured and use of injection points is strategized. For example, in certain embodiments, no lances are used and only injection points are utilized. Alternatively, lances are used and their configuration within the desludging storage tank 200 is determined at step 510.

At step 512, the volume of the content of the desludging storage tank 200 is reduced to the residual sludge and gels. The income fill crude is diverted to an alternative tank. For example, the fill crude is diverted to the alternative tank for about 72 to 96 hours.

At step 514, heating coils of the desludging storage tank 200 are turned on. At step 516, the impellers disposed on the desludging storage tank 200 are turned on and optionally, the agitation or recirculation pumps are used to further aid in sludge and/or gel reliquification.

In certain embodiments, the heating coils, impellers, and recirculation pumps, are individually attached to controller 400 by individual communication links. In certain embodiments, operation of the heating coils, impellers, and recirculation pumps, is performed by processor 432 using computer readable program code individually attached to controller 400

At step 518, the additive/diesel is injected into the tank at the configured rate of step 508. For example, the additive/diesel combination is injected into the desludging storage tank 200 via the lances and/or injection points previously described at about 10 Bar pressure. At step 520, the sludge and/or gel is agitated with nitrogen at the configured rate. For example, warm N2 (e.g., Warm Nitrogen Bubbling Concept at 60 degrees C.) is injected into the desludging storage tank 200 at 10 Bar pressure for about 12 hours. At step 522, liquefied sludge from the desludging storage tank 200 is pumped to a holding tank and educted, such as in a cracking tower. The cracking tower breaks the large hydrocarbons into smaller groupings via thermal, visbreaking, or coking means, for example. In certain embodiments, the educted chemical additives is reusable. To illustrate, the reusable additive is used at step 518 during another cycle of the method 500.

At step 524, the oil to water ratio of the incoming oil and out going liquefied sludge/gel is compared and a measurement of the tail bottom of the desludging storage tank 200 is made. For example, line samples of water and solid samples are taken after phase separation.

In certain embodiments, method 500 increases the rate of in tank phase separation in-situ that results in a crude oil layer that is recaptured. Here, the de-emulsification provides in-situ phase separation. When phase separation is completed, the separated water and solids are extracted. In certain embodiments, water is drained using a pump. The water is then treated onsite using hydro-cyclone and O-zone methodology, for example. The non-hydrocarbon solids are removed from the desludging storage tank 200 using a vacuum truck.

At step 526, a determination is made whether to continue or stop the desludging method 500. If the determination is to end, the method 500 proceeds from step 526 to step 528 and the method 500 is ended. Alternatively, if the determination is made to continue, method 500 is repeated. In certain embodiments, the entire method (e.g., steps 502 to 526) is repeated, while in other embodiments only a portion of method 500, such as one or more steps of method 500, are repeated. To illustrate, in certain embodiments, steps 502 and 504 are repeated, while in other embodiments steps 518 to 522 are repeated 5 times and after the fifth step 522, the method 500 proceeds to step 524 and the determination is made at step 526 to end the desludging method 500. In another example, the image testing 504 is conducted intermittently after repeated cycles of steps 518 to 522, such as conducting the image testing at the beginning, at the midpoint, and at the end of a set of cycles of method 500.

In certain embodiments, one or more steps of method 500 are omitted or other steps are added. To illustrate, step 522 is omitted and the sludge is not removed from the desludging storage tank 200. Here, the sludge is liquefied in a closed loop agitation. In another example, impellers or agitation pumps are not used at step 516. Rather, canon nozzles are inserted (e.g., hydraulically pushed) into the desludging storage tank 200 within the sludge layer using Cold Tap. In this methodology the canons are operated under a nitrogen blanket. Canon nozzles are aligned in the same direction to create a swirling momentum. The canons commence the swirling of the sludge. The centrifugal effect drives the denser water and non additive solids down the conical floor to the edges of the desludging storage tank 200 where they can be decanted/removed from the tank via a pump and valves (4 inch valve).

In certain embodiments, method 500 is carried out in-line such that the crude oil storage tank is cleaned with limited interruption to refinery operations. Here, the desludging of the tank is carried out without a cleaning crew entering the tank to clean it. Phase separation occurs and the additive is recaptured and reused. Consequently, there is no holding tank closure, which would result in down time due to the desludging storage tank being offline (saving $USD500,000 to 1 million dollars per day).

The schematic flow chart diagrams included are generally set forth as a logical flow-chart diagram (e.g., FIG. 5). As such, the depicted order and labeled steps are indicative of one embodiment of the presented method. In certain embodiments, other steps and methods are conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types are employed in the flow-chart diagrams, they are understood not to limit the scope of the corresponding method (e.g., FIG. 5). Indeed, some arrows or other connectors may be used to indicate only the logical flow of the method. For instance, an arrow indicates a waiting or monitoring period of unspecified duration between enumerated steps of the depicted method. Additionally, the order in which a particular method occurs may or may not strictly adhere to the order of the corresponding steps shown. In certain embodiments, individual steps recited in FIG. 5 are combined, eliminated, or reordered.

In certain embodiments, Applicants' invention includes instructions residing in the memory, such as memory 133 (FIG. 1) and/or memory 143 (FIG. 1), where those instructions are executed by system processor 132 (FIG. 1) and/or processor 142 (FIG. 1), to performs steps 220, 230, 240, 250, 260, 270, recited in FIG. 2, and/or steps 310, 320, 330, 340, 350, 360, 370, and/or 380, recited in FIG. 3, and/or to steps 410, 420, 430, 440, 450, 460, and/or 470, recited in FIG. 4, and/or steps 510, 520, 530, 540, 550, 560, and/or 570, recited in FIG. 5, and/or steps 610, 620, 630, 640, 650, 660, and/or 670, recited in FIG. 6.

In other embodiments, Applicants' invention includes instructions residing in any other computer program product, where those instructions are executed by a computer external to, or internal to, system 100, to perform steps 220, 230, 240, 250, 260, 270, recited in FIG. 2, and/or steps 310, 320, 330, 340, 350, 360, 370, and/or 380, recited in FIG. 3, and/or to steps 410, 420, 430, 440, 450, 460, and/or 470, recited in FIG. 4, and/or steps 510, 520, 530, 540, 550, 560, and/or 570, recited in FIG. 5, and/or steps 610, 620, 630, 640, 650, 660, and/or 670, recited in FIG. 6. In either case, the instructions may be encoded in an information storage medium comprising, for example, a magnetic information storage medium, an optical information storage medium, an electronic information storage medium, and the like. By "electronic storage medium," Applicants mean, for example, a device such as a PROM, EPROM, EEPROM, Flash PROM, compactflash, smartmedia, and the like.

While various embodiments have been described above, it should be understood that they have been presented by way of example only, not limitation, and various changes in form and details may be made. Any portion of the apparatus and/or methods described herein may be combined in any combination, except mutually exclusive combinations. The embodiments described herein can include various combinations and/or sub-combinations of the functions, components and/or features of the different embodiments described. For example, multiple, distributed qualification processing systems can be configured to operate in parallel.

Although the present invention has been described in detail with reference to certain embodiments, one skilled in the art will appreciate that the present invention can be practiced by other than the described embodiments, which have been presented for purposes of illustration and not of limitation. Therefore, the scope of the appended claims should not be limited to the description of the embodiments contained herein.

We claim:

1. A method for removing sludge from a crude oil storage tank comprising a bottom and a moveable roof configured to float on the top of a quantity of crude oil disposed in said crude oil storage tank, the method comprising:

reducing a volume of crude oil in the crude oil storage tank to about a level of a sludge sediment in the storage tank;

measuring a topology of the sludge disposed on said bottom using an acoustic system;

reliquefying asphaltene deposits; and pumping said reliquefying asphaltene deposits out of the crude oil storage tank;

wherein said method is performed without entry of one or more persons into said crude oil storage tank.

2. The method of claim 1, wherein:

said crude oil storage tank comprises a plurality of vertical lances coupled to said moveable roof and extending downwardly therefrom, wherein each vertical lance comprises an outlet end configured to propel a fluid therefrom in a circular pattern;

said reliquefying comprises:

providing to a first one or more of said plurality of vertical lances a first fluid formed by a fractional distillation of crude oil between 200° C. (392° F.) and 350° C. (662° F.) at atmospheric pressure; and propelling said first fluid from said first one or more vertical lances onto said sludge.

3. The method of claim 2, wherein said reliquefying comprises:

providing to a second one or more of said plurality of vertical lances diesel fuel; and propelling said diesel fuel from said second one or more vertical lances onto said sludge.

4. The method of claim 3, wherein said reliquefying comprises:

providing to a third one or more of a plurality of fluid injection devices nitrogen gas warmed to 60° C.; and propelling said heated nitrogen gas from said third one or more vertical lances at a pressure of 10 Bars onto said sludge.

5. The method of claim 1, wherein said crude oil storage tank further comprises one or more impellers, wherein said reliquefying comprises activating said one or more impellers.

6. A crude oil storage tank comprising a bottom, a moveable roof configured to float on the top of a quantity of crude oil disposed therein, a controller comprising a processor, a non-transitory computer readable medium, and computer readable program code encoded in said non-transitory computer readable medium, wherein said processor utilizes said computer readable program code to remove sludge from said crude oil storage tank, the computer readable program code comprising a series of computer readable program steps to effect:

reducing a volume of crude oil in the crude oil storage tank to about a level of a sludge sediment in the crude oil storage tank;

measuring a topology of the sludge disposed on said bottom using an acoustic system;

reliquefying asphaltene deposits; and pumping said reliquefying asphaltene deposits out of the crude oil storage tank;

wherein said method is performed without entry of one or more persons into said crude oil storage tank.

7. The crude oil storage tank of claim 6, further comprising a plurality of vertical lances coupled to said roof and extending downwardly therefrom, wherein each vertical lance comprises an outlet end configured to propel a fluid therefrom in a circular pattern, the computer readable program code further comprising a series of computer readable program steps to effect:

providing to a first one or more of said plurality of vertical lances a first fluid formed by a fractional distillation of crude oil between 200° C. (392° F.) and 350° C. (662° F.) at atmospheric pressure; and propelling said first fluid from said first one or more vertical lances onto said sludge.

8. The crude oil storage tank of claim 7, the computer readable program code further comprising a series of computer readable program steps to effect:

providing to a second one or more of said plurality of vertical lances diesel fuel; and propelling said diesel fuel from said second one or more vertical lances onto said sludge.

9. The crude oil storage tank of claim 8, the computer readable program code further comprising a series of computer readable program steps to effect:

providing to a third one or more of a plurality of fluid injection devices nitrogen gas warmed to 60° C.; and propelling said heated nitrogen gas from said third one or more vertical lances at a pressure of 10 Bars onto said sludge.

10. The crude oil storage tank of claim 9, further comprising one or more impellers, the computer readable program code further comprising a series of computer readable program steps to effect activating said one or more impellers.

11. A computer program product encoded in a non-transitory computer readable medium and usable with a programmable computer processor to remove sludge from a crude oil storage tank comprising a bottom, a moveable roof configured to float on the top of a quantity of crude oil disposed therein, comprising:

computer readable program code which causes said programmable computer processor to reduce a volume of crude oil in the crude oil storage tank to about a level of a sludge sediment in the crude oil storage tank;

computer readable program code which causes said programmable computer processor to measure a topology of the sludge disposed on said bottom using an acoustic system;

computer readable program code which causes said programmable computer processor to reliquefy asphaltene deposits; and computer readable program code which causes said programmable computer processor to pump said reliquefying asphaltene deposits out of the crude oil storage tank;

wherein said method is performed without entry of one or more persons into said crude oil storage tank.

12. The computer program product of claim 11, wherein said crude oil storage tank further comprises a plurality of vertical lances coupled to said roof and extending downwardly therefrom, wherein each vertical lance comprises an outlet end configured to propel a fluid therefrom in a circular pattern, further comprising computer readable program code which causes said programmable computer processor to provide to a first one or more of said plurality of vertical lances a first fluid formed by a fractional distillation of crude oil between 200° C. (392° F.) and 350° C. (662° F.) at atmospheric pressure, thereby propelling said first fluid from said first one or more vertical lances onto said sludge.

13. The computer program product of claim 12, further comprising:

computer readable program code which causes said programmable computer processor to provide to a second one or more of said plurality of vertical lances diesel fuel; and computer readable program code which causes said programmable computer processor to propel said diesel fuel from said second one or more vertical lances onto said sludge.

14. The computer program product of claim 13, further comprising:

computer readable program code which causes said programmable computer processor to provide to a third one or more of a plurality of fluid injection devices nitrogen gas warmed to 60° C., thereby propelling said heated nitrogen gas from said third one or more vertical lances at a pressure of 10 Bars onto said sludge.

15. The computer program product of claim 14, wherein said crude oil storage tank further comprises one or more impellers, further comprising computer readable program code which causes said programmable computer processor to activate said one or more impellers.

* * * * *